US006618968B1

(12) United States Patent
Nielsen

(10) Patent No.: US 6,618,968 B1
(45) Date of Patent: Sep. 16, 2003

(54) METHOD AND AN APPARATUS FOR INTRODUCING SUBSTANTIALLY RECTANGULAR PIECES OF LAUNDRY INTO A LAUNDRY TREATMENT APPARATUS

(75) Inventor: Steen Nielsen, Brussels (BE)

(73) Assignee: Jensen Denmark A/S, Ronne (DK)

( * ) Notice: Subject to any disclaimer, the term of this patent is extended or adjusted under 35 U.S.C. 154(b) by 0 days.

(21) Appl. No.: 09/959,513

(22) PCT Filed: May 3, 2000

(86) PCT No.: PCT/DK00/00222

§ 371 (c)(1),
(2), (4) Date: Oct. 29, 2001

(87) PCT Pub. No.: WO00/66828

PCT Pub. Date: Nov. 9, 2000

(30) Foreign Application Priority Data

May 3, 1999 (DK) ..... 1999 00600

(51) Int. Cl.[7] ..... D06F 67/04
(52) U.S. Cl. ..... 38/143
(58) Field of Search ..... 38/143, 144; 493/406, 493/418, 437, 243; 270/40, 41

(56) References Cited

U.S. PATENT DOCUMENTS 2,635,370 A 4/1953 Mann et al.
4,437,247 A * 3/1984 Wiebesiek ..... 38/143
5,546,684 A * 8/1996 Jensen ..... 38/143
5,906,061 A * 5/1999 Adler ..... 38/2

FOREIGN PATENT DOCUMENTS

DK 172194 B1 12/1997
EP 0 424 290 A1 4/1991

* cited by examiner

*Primary Examiner*—Ismael Izaguirre
(74) *Attorney, Agent, or Firm*—Finnegan, Henderson, Farabow, Garrett & Dunner, L.L.P.

(57) ABSTRACT

A method and apparatus (1) for unfolding and feeding substantially rectangular pieces of laundry (2) into a cloth treatment apparatus, such as a rotary ironer the apparatus including a conveyor (11) over which the piece of laundry (2) is positioned unfolded, hanging substantially freely and folded with a first part of the piece of laundry hanging down on the one side of the conveyor and the other part on the other side, and wherein the apparatus further includes two opposed transport faces (5, 6) in abutment with each other, a device for forming a fold on one of the substantially freely suspended portions of the piece of laundry, and a device for introducing the fold thus formed on the piece of laundry (2) between the two opposed transport faces (5, 6), the transport faces (5, 6) being in abutment with each other and configured such that the piece of laundry (2) is pulled off by the conveyor (11) with its fold first and subsequently transferred to the subjacent transport face (6).

10 Claims, 4 Drawing Sheets

METHOD AND AN APPARATUS FOR INTRODUCING SUBSTANTIALLY RECTANGULAR PIECES OF LAUNDRY INTO A LAUNDRY TREATMENT APPARATUS

BACKGROUND OF THE INVENTION

The invention relates to a method for introducing substantially rectangular pieces of laundry into a laundry treatment apparatus, such as a rotary ironed, and an apparatus for exercising the method.

Apparatuses of this kind are used primarily in large-scale laundries where they are used to smoothed and unfold large pieces of laundry, such as sheets, tablecloths, eider down cases and the like, for subsequent introduction of that piece of laundry into for instance a rotary ironed, where it is important that such feeders efficiently unfold and smoothed the pieces of laundry in order to avoid that unintended press folds occur following the rotary ironed. Most frequently the pieces of laundry are introduced into the apparatus in that a piece of laundry is fetched from a pile of laundry in its wrinkled state and optionally wet or moist, following which the piece of laundry is introduced into the feeder that subsequently treats the piece of laundry such that it can be transferred to for instance a rotary ironed in unfolded and smoothed state.

Today numerous suggested configurations of apparatus that are able to carry out said processes are known. Thus for instance U.S. Pat. No. 2,635,370 teaches an apparatus for smoothing and unfolding large pieces of laundry wherein two narrow conveyor belts are configured in abutment on each other between which the piece of laundry can be introduced and suspended to each side of the lowermost conveyor belt and following which leg air jets can be applied onto the surfaces of the cloth thereby causing the cloth to flutter and be smoothed while suspended in the apparatus. However the apparatus cannot serve as feeder in that the large piece of laundry must subsequently be manually removed from the apparatus and optionally transferred to a rotary ironed. This means that the apparatus cannot in any way whatsoever meet the requirements made to performance efficiency required in today's industrial laundries.

Published European patent application No. 424,290, on the other hand, teaches an actual feeder that comprises a short and very wide belt conveyor above which the large piece of laundry is pulled into place from its one side in that approximately the middle of an edge of the piece of laundry is inserted into grippers intended therefore that pull the cloth in place across the belt conveyor. This will typically cause the piece of laundry to be located diagonally across the belt conveyor and therefore means are provided for straightening the piece of laundry whereby two opposed edges of the piece of laundry will be caused to be situated perpendicularly to the advancement direction of the belt conveyor. In this situation the piece of laundry is suspended unfolded and smoothed across the belt conveyor and hereby a bar is provided that can transfer the piece of laundry from the belt conveyor to a subsequent cloth treatment apparatus, if any, such as a rotary ironed. However, this presupposes that the piece of laundry is positioned correctly prior to the transfer, which is accomplished by the belt conveyor advancing the piece of laundry a certain distance. Thus all of the above processes are performed while the piece of laundry hangs across the belt conveyor which means that the subsequent transfer of the piece of laundry must be relatively accurate in order to ensure that the piece of laundry is transferred in its unfolded state and with the correct orientation.

EP patent No 666,360 teaches a method and an apparatus whereby the piece of laundry cannot the straightened and unfolded until it has been introduced into the feeder as such. This is performed in that the piece of laundry is suspended across the conveyor with a relatively large side hanging on the one side of the conveyor and a relatively small side on the other side, and wherein the fold with which the piece of laundry lies across the conveyor is lifted by means of a bar that subsequently presses the piece of laundry in between two opposed transport faces that resiliently abut on each other whereby the piece of laundry is transported on the one transport face in the feeder that has means for correctly orienting and unfolding the nieces of laundry. Hereby a relatively high productivity can be obtained for the introduction of pieces of laundry since the initial straightening and unfolding of the pieces of laundry are avoided and can be performed at a later stage in the feeder.

However, it is a problem in this context that, due to the piece of laundry being suspended with its major part on the one side of the conveyor and the entire piece of laundry being lifted upwards for engagement between the two transport faces, a relatively large height of the machinery is required.

Therefore, it is the object of the present invention via to provide a method and an apparatus whereby it is possible to obtain a high degree of efficiency in the introduction process, but whereby the height that is necessary to obtain an effective handling of the pieces of laundry without them touching the support of the apparatus is reduced considerably, ceteris Paribus.

SUMMARY OF THE INVENTION

According to the invention this is obtained in that the apparatus comprises means for forming a fold on the substantially freely suspended portions of the piece of laundry and means for introducing the fold thus formed on the piece of laundry (2) between the two opposed transport faces (5,6), said transport faces (5,6) being in mutual abutment and configured such that the piece of laundry (2) is pulled of the conveyor (1) with its fold first and is subsequently conveyed onto the subjacent transport face (6).

Since the piece of laundry is hereby transferred with a fold and does not have to be oriented correctly, efficient introduction of pieces of laundry can be accomplished in a subsequent rotary ironed or the like, if any. Simultaneously as a result of the fact that the fold is established on one of the sides of the piece of laundry rather than at the top, at the conveyor, and that the fold is thereby capable of being introduced sideways between the two opposed transport faces, the machine can be constructed with a lower total height, ceteris Paribus.

Since the piece of laundry is conveyed away from the conveyor as soon as it arrives thereon the bar will quickly be ready for renewed feeding of a piece of laundry. This necessitates that the piece of laundry is introduced into the feeder with a longitudinal fold that is subsequently unfolded and that can optionally be straightened somewhere else in the machine.

According to a preferred embodiment the conveyor can comprise one or more plate elements (17) with an upper edge that extends along the entire length of the conveyor (11), longitudinally with that of the conveyor belt (16), and means for relative displacement of the upper edge of the conveyor elements to an upper and a lower position, wherein the upper edge extends upwards above and below, respectively, the upper face of the conveyor belt such that the piece of laundry.

According to a further preferred embodiment of the invention the opposed transport faces (5,6) each comprises a pair of rollers (7,8) that are located in close proximity to each other at the one side of the conveyor (11), and forms a space between the roller pairs (7,8) for introduction of the fold on the piece of laundry.

Besides, the means for forming a fold on one of the substantially freely suspended portions of the piece of laundry and the means for introducing the fold thus formed on the piece of laundry (2) between the two opposed transport faces (5,6) advantageously comprise a number of air nozzles that are located at the one side of the conveyor a distance below the uppermost face of the conveyor, said air nozzles being oriented towards the space between the two transport faces. Thereby a very simple and inexpensive introduction of pieces of laundry between the two transport faces is accomplished.

BRIEF DESCRIPTION OF THE DRAWINGS

A convenient embodiment of the invention will be described in detail in the following with reference to the drawing, wherein.

DETAILED DESCRIPTION OF THE INVENTION

Figure 1:
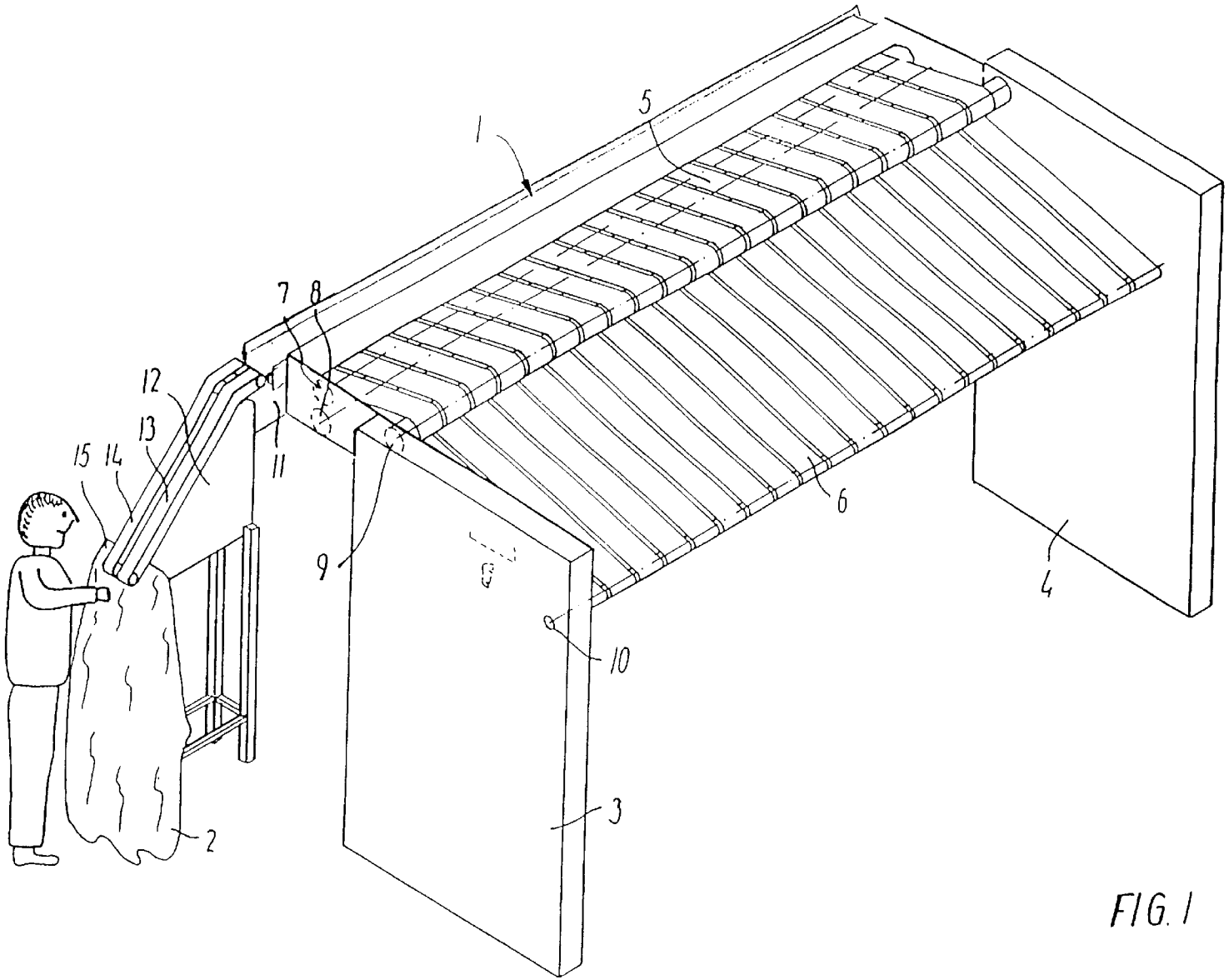
FIG. 1 shows an apparatus according to the invention seen in a perspective view, and an operator.

Thus, FIG. 1 is a schematically and perspective view of an embodiment of a feeder according to the invention. The feeder is provided with two end gables 3 and 4 between which two conveyor belts 5 and 6 are arranged. The conveyor belt 6 extends in part below the conveyor belt 5 that is spanned by the rollers 7 and 9, and the rollers 8 and 10 span the conveyor belt 6.

Opposite the rollers 7 and 8 a conveyor 11 is arranged, the functioning of which will be described in the following. As shown, at the one end of the conveyor 11 an operator-operated feeder device is arranged that, in this case, consists of a subjacent transport path 12, above which two parallel conveyor belts 13 and 14 are arranged such that they are in firm abutment on the transport path 12.

Thus the operator starts the process by introducing the piece of laundry 2 between the conveyor belts 13 and 14 and the subjacent transport path 12. The conveyor belts 13 and 14 that pull the piece of laundry 2 upwards to the conveyor 11 are then activated.

The functioning and mode of operation of the feeder will then be described as a series of individual operations in accordance with the method of the invention.

Figure 2A:
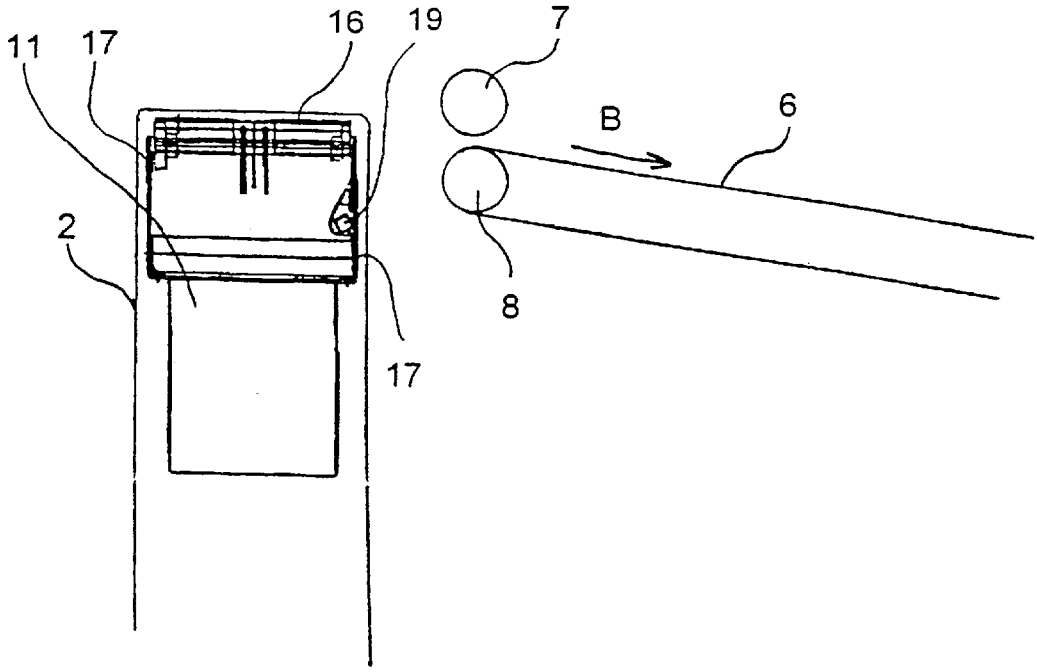
FIG. 2*a* is a schematically sectional view of a detail of the apparatus according to FIG. 1.

Thus FIG. 2*a* shows how the piece of laundry 2 is pulled across the conveyor 11 that is arranged opposite the rollers 7 and 8. As opposed to the embodiment shown in FIG. 1, it is shown herein how the roller 7 in itself forms a transport face for receiving the piece of laundry. To this end, the conveyor is provided with a conveyor belt 16 that extends throughout the entire length of the conveyor and is thus able too pull the entire piece of laundry 2 in place on the conveyor 11. The piece of laundry will subsequently, as shown in FIG. 2*a*, hang across the conveyor.

Figure 2B:
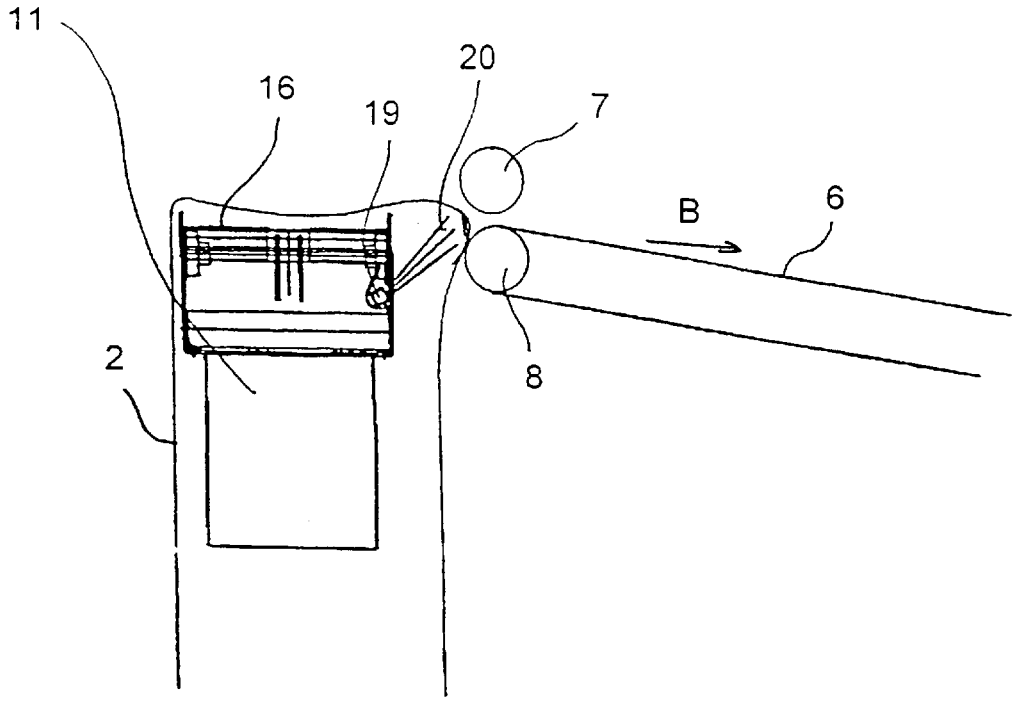
FIG. 2*b* shows the detail according to FIG. 2*a* in another process posture.

The conveyor belt 16 on the conveyor 11 is, as shown in FIG. 2*a*, lifted by means of a pneumatic actuator intended therefor, such that the upper transport face on the conveyor belt extends completely above the two gable plates 17. Now, FIG. 2*b* shows how the displace able conveyor belt 16 will, by means of the pneumatic actuator, be displaced downwards such that the upper edge of the two gable plates 17 extends completely above the transport face on the conveyor belt 16. In this position the air nozzles 19 intended therefor are subsequently activated that will, by means of an air jet 20, blow the piece of laundry 2 in between the two rollers 7 and 8 such that the piece of laundry is caught between the two rollers 7 and 8 whereby a fold is formed on the piece of laundry.

Figure 3:
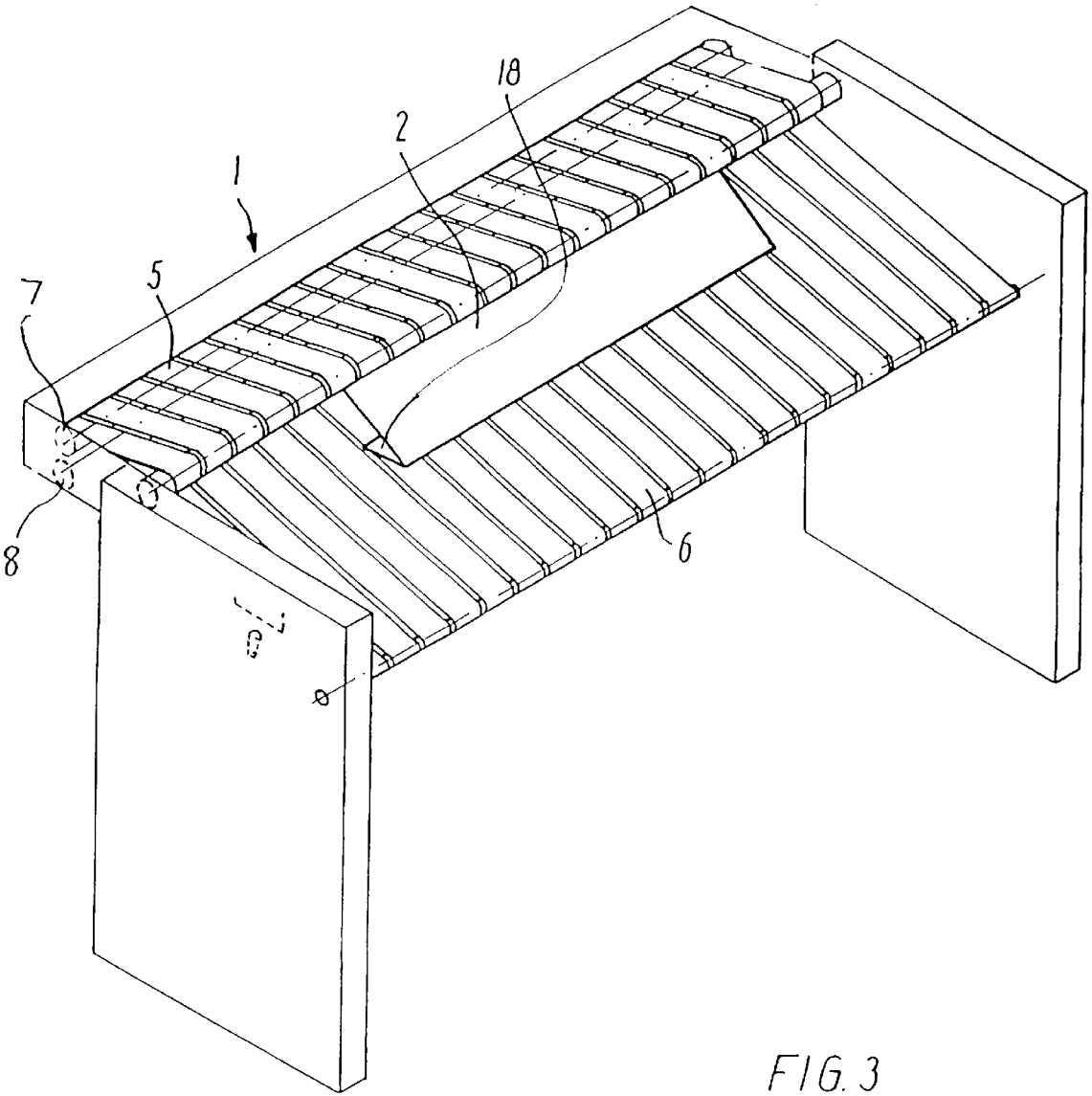
FIG. 3 shows the apparatus according to FIG. 1 with a piece of laundry that has been transferred into the feeder with a fold.
Figure 4:
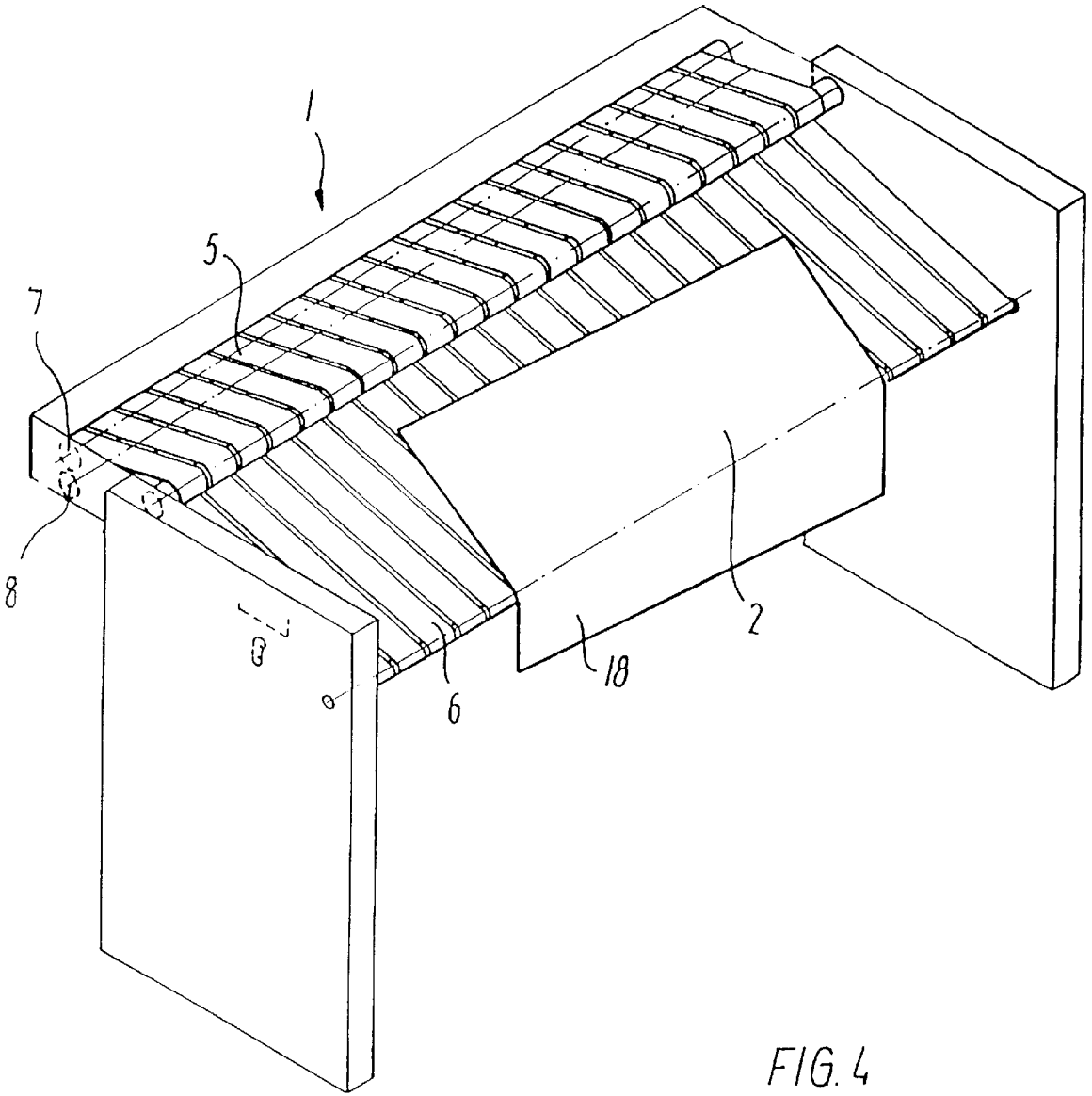
FIG. 4 shows the apparatus according to FIG. 3 wherein the piece of laundry is unfolded.

The movement of the conveyor belts 5 and 6 will subsequently cause the piece of laundry 2 with the folded flap 18 to occupy a position in which the piece of laundry 2 is situated as shown in FIG. 3 on top of the conveyor belt 6. The piece of laundry 2 thus being removed from the bar 11, the operator can already now insert a new piece of laundry 2 and restart the process again. Final unfolding of the piece of laundry 2 is then effected as shown in FIG. 4 in that the piece of laundry 2 is, by the continued movement of the conveyor belt 6 in the direction B shown in FIG. 2*b*, displaced towards that edge on the conveyor belt 6 that is defined by the roller 10 following which the folded flap 18 of the piece of laundry 2 drops over the edge and the piece of laundry is completely straightened and smoothed.

Obviously the embodiment described above and referred to in the drawings can be varied in a vast number of ways. Thus the feeder can alternatively comprise a pair of grippers that hold on to the piece of laundry 2, in principle in the same manner as is the case with the conveyor belts 13 and 14 and the transport path 12. Moreover, these grippers can be configured such that they pull the piece of laundry 2 all the way across the gable plates 17 whereby the conveyor belts 16 of the conveyor become redundant.

As regards the transport faces in this construction, they can also alternatively and optionally consist of roller paths, air cushion paths and the like without departing from the inventive idea of the invention.

Besides, it will also be obvious to the person skilled in the art to provide sequence controls and drive means, etc., whereby the feeder 1 is capable of automatically performing the above-described functions.

It should be noted, however, that the embodiment shown in the drawings distinguishes itself in being of a particularly early simple and inexpensive construction, and tests with the feeder 1 have proved that it is possible to obtain an unusually high productivity with a single operator. However, it is possible—if desired—that the same apparatus be operated by several operators in which case each operator has at his disposal a separate feeder.

What is claimed is:

1. A method of feeding substantially rectangular pieces of laundry into a cloth treatment apparatus, comprising unfolding a piece of laundry, wherein the piece of laundry is positioned straightened, hanging the piece of laundry over a conveyor so that a first portion of the piece of laundry is caused to hang substantially freely down on one side of the conveyor, and a second portion of the piece of laundry on an opposite side of the conveyor, forming a fold in the piece of laundry, and engaging said fold between two opposed transport faces that are in abutment with each other and that subsequently pull the piece of laundry off the conveyor with said fold first, wherein the fold in the piece of laundry is provided at a distance down from the conveyor and in one of the freely hanging first or second portions of the piece of laundry.

2. The method of claim 1, wherein the piece of laundry is subsequently transported on a subjacent transport face with the fold first in the transport direction towards a finishing edge on the subjacent transport face far enough that the fold and the folded part of the piece of laundry drops over the finishing edge of the transport face, the remaining portion of the piece of laundry being secured on the subjacent transport face.

3. The method of claim 1 or 2, wherein the hanging of the piece of laundry over the conveyor involves stretching of an edge of the straightened piece of laundry and inserting the stretched edge into a gripper device at the one end of the conveyor, said gripper pulling the piece of laundry across a first end of the conveyor, following which the conveyor pulls the piece of laundry longitudinally off the conveyor with the first portion of the piece of laundry hanging down on the one side of the conveyor, and the second portion on the opposite side.

4. An apparatus for unfolding and feeding substantially rectangular pieces of laundry into a cloth treatment apparatus, said apparatus comprising a conveyor over which the piece of laundry is arranged so that it hangs substantially freely with a first portion of the piece of laundry hanging down on one side of the conveyor and a second portion of the piece of laundry on an opposite side of the conveyor, two opposed transport faces that are in abutment with each other, means for forming a fold in one of the freely hanging first and second portions of the piece of laundry at a distance down from the conveyor, and means for feeding the fold thus formed in the piece of laundry between the two opposed transport faces, said transport faces being configured such that the piece of laundry is pulled off the conveyor with its fold first and is subsequently transferred to a subjacent transport face.

5. The apparatus of claim 4, wherein the subjacent transport face is configured such that the piece of laundry can be transported with the fold first in a direction towards a finishing edge on the transport face far enough that the fold and the folded part of the piece of laundry drop over the finishing edge of the transport face.

6. The apparatus of claim 4 or 5, wherein the conveyor comprises a conveyor belt with an upper transport face that extends the entire length of the conveyor, said transport belt being configured to pull the piece of laundry from one end of the conveyor and across the conveyor so that the first and second portions of the piece of laundry hang freely down the two sides of the conveyor.

7. The apparatus of claim 6, wherein the conveyor further comprises one or more plates having an upper edge that extends along the entire length of the conveyor longitudinally of the conveyor belt, and displacement means for displacing the upper edge of the one or more plates between an upper and a lower position wherein the upper edge extends above and below, respectively, the upper transport face of the conveyor belt.

8. The apparatus of claim 7, wherein the displacement means lower and lift the conveyor belt relative to the upper edge of the one or more plates.

9. The apparatus of claim 4, wherein the opposed transport faces each extends around one of a pair of rollers that are located in close proximity to each other at the one side of the conveyor where the fold is formed and provide a space between them into which the fold in the piece of laundry is fed.

10. The apparatus of claim 4, wherein the means for forming the fold in one of the substantially freely hanging first and second portions of the piece of laundry and the means for feeding the fold thus formed in the piece of laundry between the two opposed transport faces comprises a plurality of air nozzles that are located at the one side of the conveyor where the fold is formed a distance below an upper face of the conveyor, said air nozzles being oriented towards a space between the two transport faces.

* * * * *